US009190257B2

(12) United States Patent
Otsuka et al.

(10) Patent No.: US 9,190,257 B2
(45) Date of Patent: Nov. 17, 2015

(54) IONIZATION METHOD, MASS SPECTROMETRY METHOD, EXTRACTION METHOD, AND PURIFICATION METHOD

(71) Applicants: A SCHOOL CORPORATION KANSAI UNIVERSITY, Osaka (JP); CANON KABUSHIKI KAISHA, Tokyo (JP)

(72) Inventors: Yoichi Otsuka, Kawasaki (JP); Ryuichi Arakawa, Itami (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 13/972,063

(22) Filed: Aug. 21, 2013

(65) Prior Publication Data

US 2013/0334030 A1 Dec. 19, 2013

Related U.S. Application Data

(63) Continuation of application No. PCT/JP2013/001237, filed on Feb. 28, 2013.

(30) Foreign Application Priority Data

Mar. 1, 2012 (JP) ..... 2012-045922

(51) Int. Cl.
*H01J 49/10* (2006.01)
*H01J 49/16* (2006.01)
*H01J 49/04* (2006.01)

(52) U.S. Cl.
CPC ..... *H01J 49/165* (2013.01); *H01J 49/0454* (2013.01)

(58) Field of Classification Search
CPC ... H01J 49/0027; H01J 49/04; H01J 49/0431; H01J 49/0454; H01J 49/165
See application file for complete search history.

(56) References Cited

U.S. PATENT DOCUMENTS 5,306,412 A * 4/1994 Whitehouse et al. ..... 204/452
5,945,678 A 8/1999 Yanagisawa
6,566,653 B1 5/2003 Gerber (Continued)

FOREIGN PATENT DOCUMENTS

JP 9-306417 A 11/1997
JP 10-112279 A 4/1998

(Continued)

OTHER PUBLICATIONS

International Search Report in PCT/JP2013/001237 (mailed May 14, 2013).

(Continued)

*Primary Examiner* — Jack Berman
(74) *Attorney, Agent, or Firm* — Fitzpatrick, Cella, Harper & Scinto

(57) ABSTRACT

The present invention has an object to achieve soft ionization more easily when a slight amount of substance is ionized under an atmosphere pressure. The present invention provides an ionization method for a substance contained in a liquid, including: supplying the liquid to a substrate from a probe and forming a liquid bridge made of the liquid containing the substance dissolved therein, between the probe and the substrate; oscillating the substrate; and generating an electric field between an electrically conductive portion of the probe in contact with the liquid and an ion extraction electrode.

15 Claims, 8 Drawing Sheets

(56) References Cited

U.S. PATENT DOCUMENTS

| | | | | |
|---|---|---|---|---|
| 6,627,882 | B2 | 9/2003 | Schultz et al. | |
| 6,723,985 | B2 | 4/2004 | Schultz et al. | |
| 6,737,640 | B2 | 5/2004 | Kato | |
| 6,803,566 | B2 * | 10/2004 | Van Berkel | 250/288 |
| 8,097,845 | B2 * | 1/2012 | Roach et al. | 250/288 |
| 8,710,436 | B2 * | 4/2014 | Otsuka | 250/288 |
| 8,957,370 | B1 * | 2/2015 | Kyogaku et al. | 250/288 |
| 9,058,966 | B2 * | 6/2015 | Otsuka | 1/1 |
| 2010/0224013 | A1 * | 9/2010 | Van Berkel et al. | 73/863.81 |
| 2013/0341279 | A1 * | 12/2013 | Otsuka et al. | 210/663 |
| 2014/0070089 | A1 * | 3/2014 | Otsuka | 250/282 |
| 2014/0070093 | A1 * | 3/2014 | Otsuka | 250/288 |
| 2014/0072476 | A1 * | 3/2014 | Otsuka | 422/83 |
| 2015/0034817 | A1 * | 2/2015 | Otsuka et al. | 250/282 |

FOREIGN PATENT DOCUMENTS

| | | | |
|---|---|---|---|
| JP | 2003-130848 | A | 5/2003 |
| JP | 2003-519889 | A | 6/2003 |
| WO | 92/21138 | A1 | 11/1992 |
| WO | 03/065405 | A1 | 8/2003 |
| WO | 2011/060369 | A1 | 5/2011 |

OTHER PUBLICATIONS

Dong Weon Lee et al., "Switchable Cantilever for a Time-of-Flight Scanning Force Microscope," 84(9) Appl. Phys. Lett. 1558-1560 (Mar. 2004).

Non-final Office Action in U.S. Appl. No. 13/973,305 (mailed May 8, 2015).

International Preliminary Report on Patentability in PCT/JP2013/001237 (issued Sep. 2, 2014).

Patrick J. Roach et al., "Nanospray Desorption Electrospray Ionization: An Ambient Method for Liquid Extraction Surface Sampling in Mass Spectrometry" 135 Analyst 2233-2236 (2010).

Kenzo Hiraoka, "Fundamentals of Mass Spectrometry: Fundamentals of Electrospray," 58(4) J. Mass Spectrom. Soc. Jpn. 139-154 (2010).

P. W. Kirlew et al., "Investigation of a Modified Oscillating Capillary Nebulizer Design as an Interface for CE-ICP-MS," 52(5) Appl. Spectrosc. 770-772 (May 1998) (XP000776228).

Extended European Search Report in European Application No. 13754786.5 (dated Sep. 28, 2015).

* cited by examiner

IONIZATION METHOD, MASS SPECTROMETRY METHOD, EXTRACTION METHOD, AND PURIFICATION METHOD

CROSS-REFERENCE TO RELATED APPLICATIONS

This application is a continuation of International Application No. PCT/JP2013/001237, filed Feb. 28, 2013, which claims the benefit of Japanese Patent Application No. 2012-045922, filed Mar. 1, 2012.

BACKGROUND OF THE INVENTION

1. Field of the Invention

The present invention relates to an ionization method for a substance and a mass spectrometry method using the ionization method. The present invention also relates to an extraction method and purification method for a substance.

2. Description of the Related Art

A mass spectrometry method that is one of component analysis methods involves ionizing components in a sample and measuring and analyzing the mass-to-charge ratio (mass number/charge number) thereof.

In recent years, techniques of creating an image of the distribution of components existing on a solid sample surface are developed. The distribution of a particular component is visualized as a mass image, whereby conditions of a sample can be determined. As an example of such techniques, a method of showing data that serves as the basis for a pathological diagnosis, based on a mass image of a pathological specimen including cancer tissue is developed. A mass image is generally acquired by: ionizing a sample at a plurality of measurement points; obtaining the mass-to-charge ratio of the generated ions for each measurement point; and associating a position on the sample surface with ion information. Hence, in order to improve the spatial resolution of the obtained analysis result, a technique of ionizing a micro region on the sample surface is required.

Patrick J. Roach et al., "Nanospray desorption electrospray ionization: an ambient method for liquid extraction surface sampling in mass spectrometry" Analyst, 135, pp 2233-2236 (2010) proposes a method of: imparting a solvent to a micro region on a solid sample surface such that components existing in the micro region are dissolved; and ionizing the dissolved components under an atmosphere pressure. This method uses: a first capillary configured to provide the solvent for dissolving the components in the solid sample, to the sample surface; and a second capillary configured to move a mixture solution in which the components are dissolved in the solvent, to an ionization site. In the state where the two capillaries are close to the solid sample surface, the solvent is provided thereto by the first capillary, whereby a liquid bridge is formed between the leading ends of the two capillaries and the sample surface. In the liquid bridge, only a contact portion of the solid sample is dissolved, and the dissolved portion is then introduced to the second capillary. A high voltage is applied to the solvent, and ionization is performed at the leading end of the second capillary. This method enables the ionization of the micro region. Further, because the ionization is performed under an atmosphere pressure, the time required for measurement can be shortened, and the size of an apparatus can be reduced. Hence, this method is advantageous when a large number of samples are analyzed.

International Publication No. WO 2011/060369 proposes a method of: irradiating a mixture solution containing a sample dissolved therein, with a surface acoustic wave; and thus ionizing the contained components under an atmosphere pressure. According to this method, the mixture solution in which the sample is dissolved in a solvent is placed on a substrate, and is irradiated with the surface acoustic wave, thus achieving liquid atomization and then sample ionization. Moreover, according to International Publication No. WO 2011/060369, the ionization efficiency can be improved by applying voltage to the mixture solution.

A technique of detecting biological components as multiply charged ions is also required in mass spectrometry for materials of biological origin such as biological tissue. In the case where the molecular weight of a detection target component is relatively large, if the mass-to-charge ratio is made lower by imparting many electric charges, the component can be easily detected by even a detector whose detectable mass-to-charge ratio is low.

SUMMARY OF THE INVENTION

In the method disclosed in Patrick J. Roach et al., "Nanospray desorption electrospray ionization: an ambient method for liquid extraction surface sampling in mass spectrometry" Analyst, 135, pp 2233-2236 (2010), the contact area between the liquid bridge and the solid sample corresponds to a region on which the mass spectrometry is performed, and hence the liquid bridge needs to be made smaller in order to make this area smaller. Unfortunately, it is difficult for this method to form a liquid bridge having a size smaller than the closest distance of the leading ends of the two capillaries, and hence this method has a problem that improvement in spatial resolution achieved by making the ionization site smaller is difficult. This method has another problem that, in order to physically bring the two capillaries closer, a mechanism for precise alignment of the two capillaries is additionally required, the number of parts forming an apparatus increases, and the apparatus itself is more complicated.

In the method disclosed in International Publication No. WO 2011/060369, the measurement target is a mixture solution in which a measurement target component is dissolved in advance in a solvent, and hence it is difficult for this method to ionize part of the solid sample. Further, this method has a problem that the valence of a multiply charged ion is smaller than that of a conventional electrospray method.

As has been described above, no document discloses a method of effectively detecting, as multiply charged ions, organic components such as biological molecules from a particular region of a solid substance under an atmosphere pressure.

An ionization method of the present invention is an ionization method for a substance contained in a liquid, including: (1) supplying the liquid onto a substrate from a probe and forming a liquid bridge made of the liquid containing the substance, between the probe and the substrate; (2) oscillating the substrate; and (3) generating an electric field between an electrically conductive portion of the probe in contact with the liquid and an ion extraction electrode.

According to the present invention, a slight amount of substance contained in a liquid can be easily ionized under an atmosphere pressure.

Further features of the present invention will become apparent from the following description of exemplary embodiments with reference to the attached drawings.

DESCRIPTION OF THE EMBODIMENTS

Figure 1:
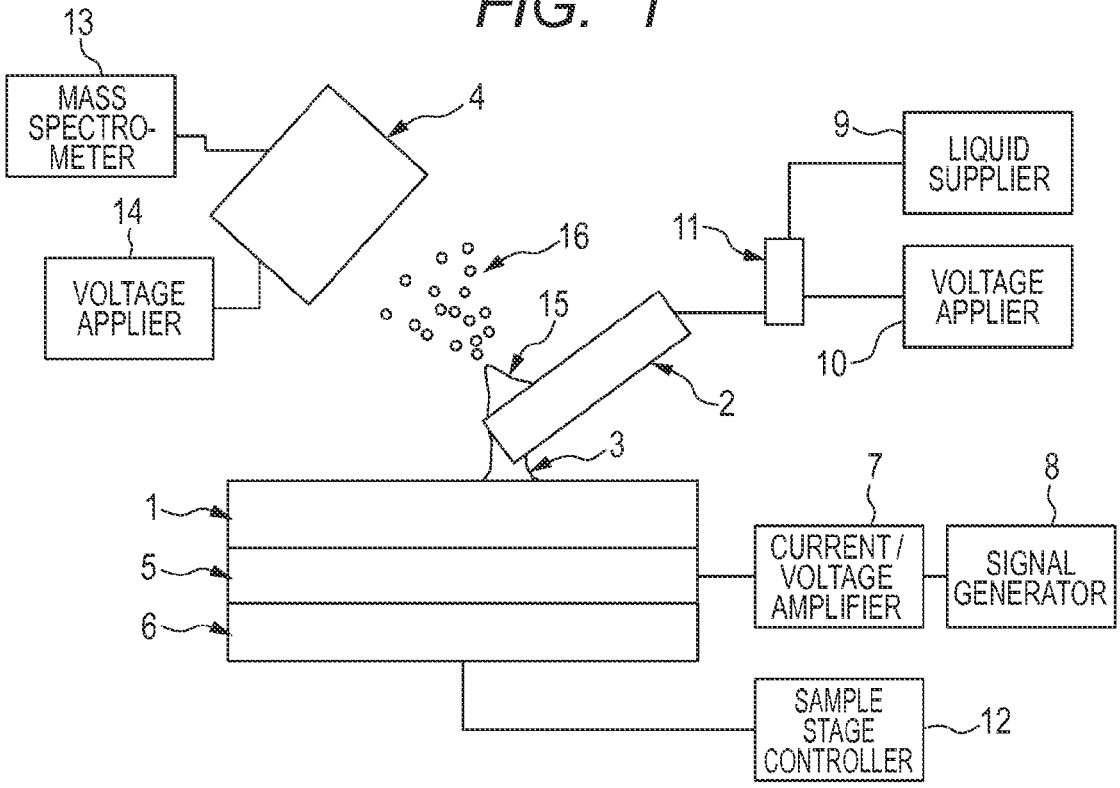
FIG. 1 is a diagram for describing a first embodiment of the present invention.

Hereinafter, a method of the present invention is described with reference to the drawings. An exemplary embodiment for carrying out the present invention is illustrated in FIG. 1. FIG. 1 illustrates: a substrate 1; a probe 2 including a flow path through which a liquid passes; a liquid bridge 3 formed between the substrate 1 and the probe 2; an ion take-in part 4 including an ion extraction electrode for taking ions into a mass spectrometer; an oscillation provider 5 configured to oscillate the substrate 3; and a sample stage 6 configured to support the oscillation provider 5 and the probe 2. FIG. 1 also illustrates: a current/voltage amplifier 7; a signal generator 8; a liquid supplier 9 configured to provide the liquid to the probe 2; a voltage applier 10; an electrically conductive flow path 11; a sample stage controller 12; the mass spectrometer 13; a voltage applier 14; a Taylor cone 15; and charged micro droplets 16.

In the present invention, first, the liquid supplied from the liquid supplier 9 forms the liquid bridge 3 between the substrate 1 and the probe 2. Then, the liquid bridge 3 is changed to the charged micro droplets 16 by oscillations of the substrate 1 made by the oscillation provider 5 and an electrical potential gradient made by the voltage applier 10 and the voltage applier 14, whereby a measurement target component can be taken as ions into the ion take-in part 4.

That is, in the present embodiment, the probe corresponds to an imparting unit of the liquid onto the substrate, an acquiring unit of a substance on the substrate, a transporting unit of the liquid to an appropriate position for ionization, and a forming unit of the Taylor cone for ionization.

The liquid supplier 9 supplies one of: a solvent for dissolving an analysis target element contained in a sample fixed onto the substrate 3; and a mixture solution of the analysis target element and a solvent for dissolving the analysis target element (hereinafter, the solvent and the mixture solution are collectively simply referred to as liquid). The liquid supplied from the liquid supplier 9 is guided to the flow path inside of the probe 2 via the electrically conductive flow path 11. At this time, voltage is applied to the liquid by the voltage applier 10 through the electrically conductive flow path 11. Any of DC voltage, AC voltage, pulse voltage, and zero voltage is applied to the liquid.

In the case where the entirety or a part of the electrically conductive flow path 11 is subsumed in the flow path inside of the probe 2 or piping for connection, the term "probe" in the present embodiment refers to a collective concept thereof. Further, even in the case where the electrically conductive flow path 11 is not subsumed in the flow path inside of the probe 2 or the piping for connection, the term "probe" in the present embodiment refers to a collective concept thereof in a broad sense. That is, at least part of the material forming the probe may be electrically conductive. Examples of the electrically conductive material include metal and semiconductor, and any material can be adopted therefor as long as the material shows a reproducible constant voltage value when voltage is applied thereto from the voltage applier. That is, in the present embodiment, voltage is applied to an electrically conductive portion of the probe, whereby voltage is applied to the liquid.

The phrase "applying voltage to the probe" in the present embodiment refers to: imparting an electrical potential different from an electrical potential of the ion extraction electrode to be described later, to the electrically conductive portion forming at least part of the probe; and generating an electric field between the electrically conductive portion forming at least part of the probe and the ion extraction electrode to be described later. As long as this electric field is achieved, the voltage applied here may be zero voltage. The material of the flow path 11 may be an electrically conductive substance, and examples of the material used therefor include stainless steel, gold, and platinum.

Examples of the used piping for connection of the probe 2, the electrically conductive flow path 11, and the liquid supplier 9 include capillaries configured to supply a slight volume of liquid, such as a silica capillary and a metal capillary, and the electrical conductivity thereof may be any of insulative, conductive, and semiconductive properties. Note that the electrically conductive flow path 11 may constitute part of a flow path in which the liquid supplied from the liquid supplier 9 passes through the inside of the probe 2 to be introduced to the leading end of the probe 2 opposite to the liquid supplier 9, and the position of the electrically conductive flow path 11 is not particularly limited. For example, the entirety or a part of the electrically conductive flow path 11 may be subsumed in the flow path inside of the probe 2 or the piping for connection. For such a configuration, it is possible to use a probe formed by inserting an electrically conductive material such as a stainless steel wire, a tungsten wire, and a platinum wire into a silica capillary.

In the case where the entire probe 2 is electrically conductive, the voltage applied to the electrically conductive flow path 11 is propagated to the probe 2, and voltage is applied to the liquid flowing through the flow path inside of the probe 2. The detail of such an embodiment is described later in a second embodiment of the present invention. Meanwhile, in the case where the probe 2 is insulative, the voltage applied to the electrically conductive flow path 11 cannot be propagated to the probe 2, but voltage is applied to the liquid flowing through the flow path 11, and this liquid is introduced to the probe 2. Consequently, even in the case where voltage is not propagated to the probe 2, voltage is applied to the liquid, so that the liquid is charged.

The liquid supplied from the liquid supplier 9 is provided onto the substrate 1 from the leading end of the probe 2. At this time, the sample may be fixed in advance onto the substrate, and a particular component as the analysis target element contained in the sample on the substrate 1 may be dissolved in the solvent provided by the probe 2. Alternatively, the mixture solution in which the analysis target element is mixed in advance with the solvent may be provided onto the substrate 1. Further, a plurality of types of liquid may be used.

According to the present invention, in the state where the probe 2 and the substrate 1 are connected to each other with the intermediation of the liquid, oscillations are imparted to the substrate 1, and an electric field is generated between the probe 2 and the ion extraction electrode, whereby the substance is ionized. The state where two objects are connected to each other with the intermediation of a liquid is generally referred to as liquid bridge. In the present embodiment, the liquid bridge 3 refers to the state where the liquid provided by the probe 2 is in physical contact with at least both the probe 2 and the substrate 1. Note that the liquid bridge in the present invention is not limited to the state where the liquid bridge is in contact with only the substrate 1 and the probe 2, and the liquid bridge may be in contact with another object than the substrate 1 and the probe 2. The liquid is continuously or intermittently provided by the probe 2 onto the substrate 1. The probe 2 does not necessarily need to come into contact with the substrate 1, but may come into contact therewith for the purpose of stable formation of the liquid bridge 3.

That is, the method of the present invention includes: (1) supplying the liquid onto the substrate from the probe and forming the liquid bridge made of the liquid containing the substance, between the probe and the substrate; (2) oscillating the substrate; and (3) generating the electric field between the electrically conductive portion of the probe in contact with the liquid and the ion extraction electrode.

Then, the (1) supplying and forming, the (2) oscillating, and the (3) generating can be performed at the same time with a simple configuration.

In FIG. 1, the substrate 1 is supported by the oscillation provider 5, and oscillations are provided to the substrate 1 by the oscillation provider 5. FIG. 1 illustrates the state where the substrate 1 is fixed to the oscillation provider 5, but the substrate 1 and the oscillation provider 5 may be separated from each other as long as the substrate 1 can oscillate to transmit its oscillations to the liquid bridge 3.

The oscillations of the substrate 1 may be any of continuous oscillations and intermittent oscillations. It is desirable to adjust the timing of applying voltage to the liquid and the timing of oscillating the substrate 1 such that the substrate 1 oscillates when the liquid to which the voltage is applied through the flow path 11 forms the liquid bridge 3. The oscillation provider is electrically connected to the current/voltage amplifier 7 and the signal generator 8, and a signal that is generated by the signal generator 8 and has a desired waveform is input to the current/voltage amplifier 7, whereby a high-voltage signal can be generated. On this occasion, the amplitude of oscillations can be set to a desired value by changing a voltage value output from the current/voltage amplifier 7.

Further, oscillations may be always provided, and an oscillating state and a non-oscillating state may be alternately caused. In the case where the oscillating state and the non-oscillating state are alternately caused, the period of each state can be changed as desired. In the case where the liquid is intermittently provided onto the substrate 1 by the probe 2, it is desirable to change the period of each of the oscillating state and the non-oscillating state such that the oscillations are transmitted to the liquid forming the liquid bridge.

The liquid forming the liquid bridge 3 is oscillated to be moved toward the side surface of the probe 2 on the ion take-in part 4 side by an electrical potential gradient between the probe to which voltage is applied and the ion extraction electrode to which voltage is applied by the voltage applier 14, so that the liquid forms the Taylor cone 15. Because the electrical potential gradient becomes larger at the leading end of the Taylor cone 15, the charged micro droplets 16 are generated from the mixture solution. If the magnitude of the electrical potential gradient is set to an appropriate value, a Rayleigh fission occurs, ions of the particular component are generated from the charged droplets 16, and the ions are guided toward the ion take-in part 4 by a flow of air and the electrical potential gradient. The ion take-in part 4 is heated to a particular temperature between room temperature and several hundreds of degrees. Voltage is applied to the ion take-in part 4. The ion take-in part 4 is connected to an air exhaust. At this time, it is necessary to adjust the voltage that is applied to the probe by the voltage applier 10 and the voltage that is applied to the ion extraction electrode by the voltage applier 14 such that an appropriate electrical potential gradient is generated so as to cause the Rayleigh fission and generate ions. Examples of the voltage applied by the voltage applier 14 include DC voltage, AC voltage, pulse voltage, zero voltage, and combinations thereof. Note that the electrical potential gradient for causing the Rayleigh fission is defined by the electrical potential applied to the probe, the electrical potential of the ion take-in part 4, and the distance between the liquid and the ion take-in part 4. Hence, depending on the types of a substance to be ionized and a solvent, these electrical potentials and distance need to be set such that an appropriate electrical potential gradient is generated. The Rayleigh fission here refers to a phenomenon in which the charged droplets 6 reach a Rayleigh limit and excessive electric charges in the charged droplets are emitted as secondary droplets. It is known that components contained in the charged droplets 6 are generated as gas-phase ions during the occurrence of such a Rayleigh fission. (J. Mass Spectrom. Soc. Jpn. Vol. 58, 139-154, 2010)

The distance between the ion take-in part 4 and the probe 2 and the distance between the ion take-in part 4 and the substrate 1 can be changed as desired, and can be set so as to satisfy conditions for stably forming the Taylor cone. Further, the angle of the probe 2 to the substrate 1 can be equal to or more than 0 and equal to or less than 90, and the angle of the ion take-in part 4 to the substrate 1 can be equal to or more than 0 and equal to or less than 90. Assuming that a plane including a line segment of the probe 2 crosses the substrate 1, the angle of the probe 2 to the substrate 1 here refers to an angle defined by: the intersection line of this plane and the substrate 1; and the line segment of the probe 2. Assuming that a plane including a line segment of the ion take-in part 4 crosses the substrate 1, the angle of the ion take-in part 4 to the substrate 1 here refers to an angle defined by: the intersection line of this plane and the substrate 1; and the line segment of the ion take-in part 4. The line segment of the capillary refers to a line segment parallel to the longer axis of the capillary. The line segment of the ion take-in part 4 refers to a line segment parallel to the axis thereof in the direction in which the ion take-in part 4 takes in ions. The probe 2 and the ion take-in part 4 do not necessarily need to be linear, and may have a curved shape. In this case, a portion that can be approximated as a straight line at the leading end of the probe 2 close to the substrate (the leading end of the ion take-in part 4 close to the substrate) is assumed as the line segment of the probe 2 (the ion take-in part 4). According to studies of the inventors of the present invention, an appropriate angle of the probe 2 is 20 degrees to 40 degrees, and an appropriate angle of the ion take-in part 4 is 30 degrees to 50 degrees, but the present invention is not limited thereto. It is considered that ions can be stably generated under conditions under which the Taylor cone can be stably formed at the leading end of the capillary.

After that, the ions are introduced to a mass spectrometer connected to the ion take-in part 4, through a differential pumping system, and the mass-to-charge ratio of the ions is measured. Examples of the used mass spectrometer include a quadrupole mass spectrometer, a time-of-flight mass spectrometer, a magnetic field deflecting mass spectrometer, an ion-trap mass spectrometer, and an ion-cyclotron mass spectrometer. Further, if the correlation between the mass-to-charge ratio (mass number/charge number; hereinafter, referred to as m/z) of the ions and the amount of generated ions is measured, the mass spectrum can also be obtained.

The size of the Taylor cone 15 changes depending on the flow rate of the liquid, the composition of the liquid, the shape of the probe 2, the oscillations of the substrate 1, and the magnitude of the electrical potential gradient. In the case where the Taylor cone 15 is extremely small, the form thereof may not be observable by a microscope, but there is no problem as long as ions are stably generated.

According to the present embodiment, the formation time of the liquid bridge 3 is adjusted by controlling the flow rate of the liquid and the oscillations of the substrate 1, whereby the volume of the liquid forming the liquid bridge 4 can be easily controlled. Hence, when the mixture solution in which the analysis target element is mixed in advance with the solvent is provided from the probe, the amount of the analysis target element to be ionized can be finely adjusted. Similarly, when the sample is fixed onto the substrate 1 to be dissolved in the solvent provided by the probe, a region with which the liquid bridge 3 comes into contact is made smaller by adjusting the formation time of the liquid bridge 3, and only components in the micro region can be ionized, thus achieving high-resolution mass spectrometry imaging of a biological substance such as a cell.

In the case where the sample is fixed onto the substrate when ionized, the position of the substrate stage 6 is changed by the sample stage controller 12, whereby the coordinates at an ionization target position of the sample can be controlled. The coordinates of the ionization target position and the obtained mass spectrum are associated with each other, whereby the two-dimensional distribution of the mass spectrum can be obtained. Data obtained according to this method is three-dimensional data containing the coordinates (an X coordinate and a Y coordinate) of the ionization target position and the mass spectrum. After the ionization and the mass spectrum acquisition are performed at different positions, the amount of ions having a desired mass-to-charge ratio is selected, and the distribution thereof is displayed. Consequently, a mass image can be obtained for each component, and the distribution of a particular component on the sample surface can be captured. The sample may be moved such that the liquid bridge 3 formed by the probe 2 scans a desired plane to be measured.

Figure 2:
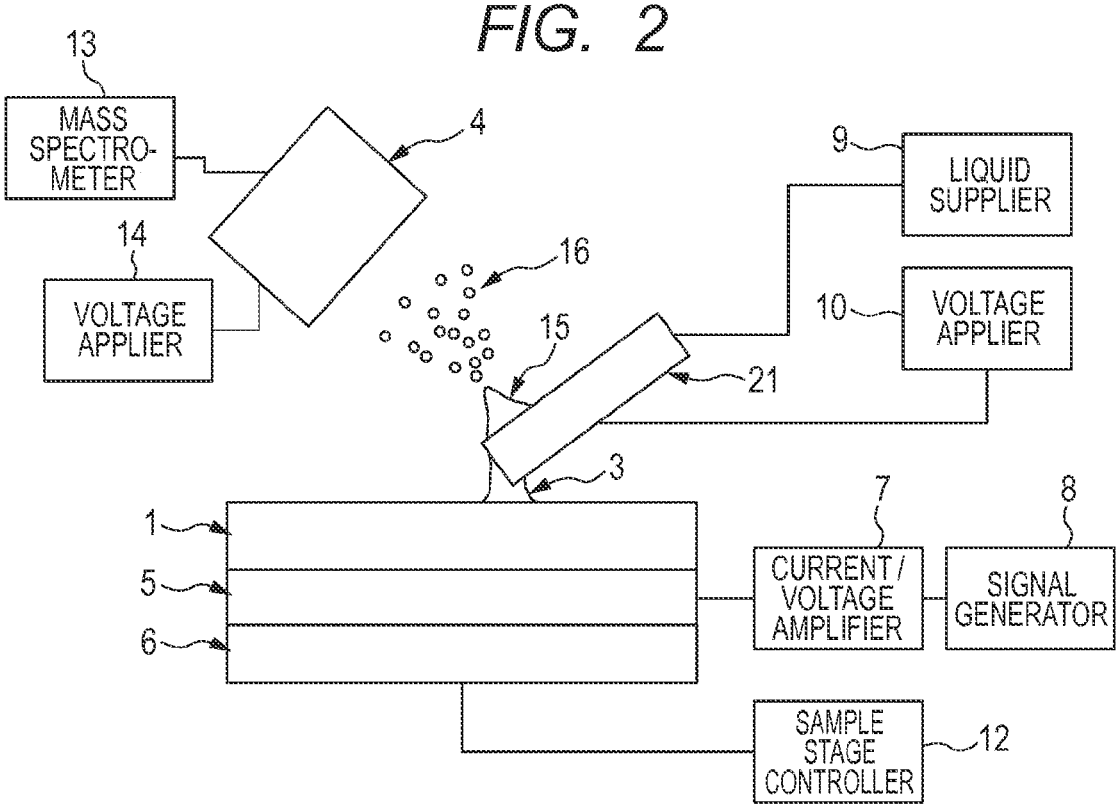
FIG. 2 is a diagram for describing a second embodiment of the present invention.

In the second embodiment of the present invention, as illustrated in FIG. 2, voltage may be applied to the liquid bridge with the intermediation of a probe including a flow path through which the liquid passes. At this time, a probe 21 is electrically connected to the voltage applier 10, and voltage is applied to the liquid supplied from the liquid supplier 9, with the intermediation of the probe 21. Note that, similarly to the above-mentioned embodiment, the phrase "applying voltage to the probe" refers to: imparting an electrical potential different from an electrical potential of the ion extraction electrode, to the electrically conductive portion forming at least part of the probe; and generating an electric field that enables ion generation due to a Rayleigh fission, between the ion extraction electrode and the probe. As long as this electric field is achieved, the voltage applied here to the electrically conductive portion forming at least part of the probe may be zero voltage. The material of the probe 21 may be an electrically conductive substance, and examples of the material used therefor include: metal such as stainless steel, gold, and platinum; and derivatives such as glass partially coated with metal.

Figure 3:
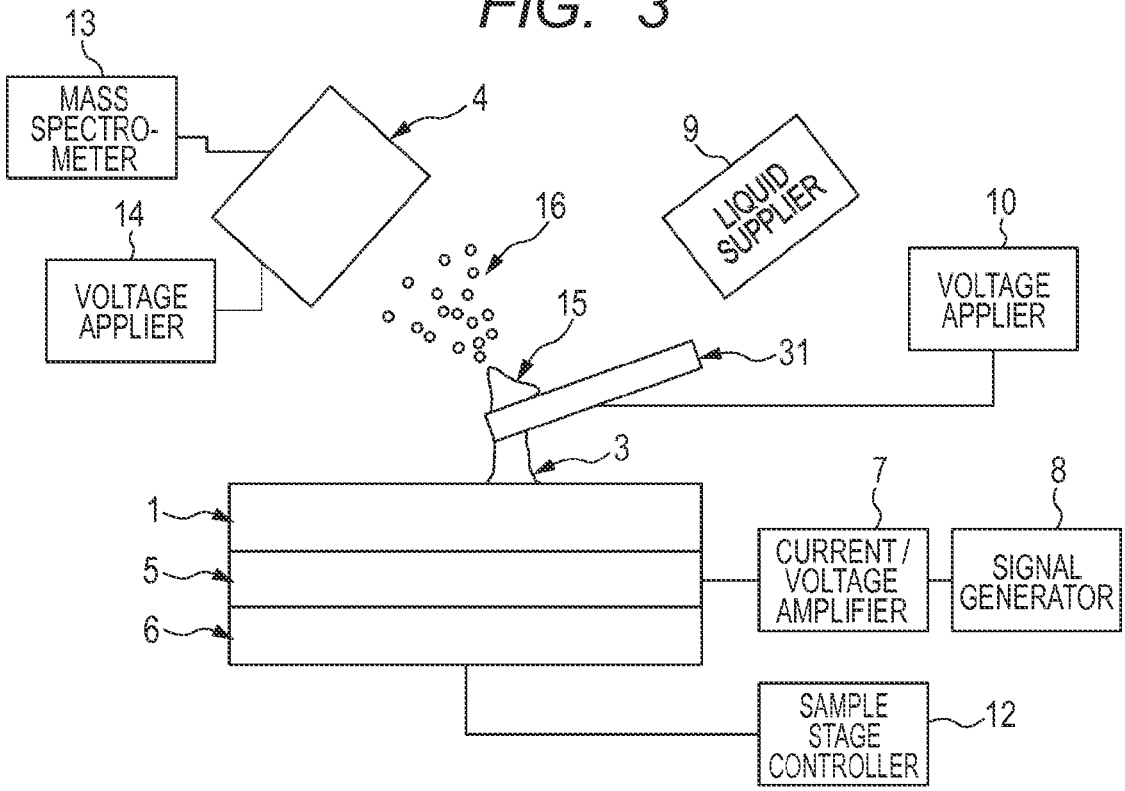
FIG. 3 is a diagram for describing a third embodiment of the present invention.

In a third embodiment of the present invention, as illustrated in FIG. 3, a probe does not necessarily need to include a flow path through which the liquid passes. That is, the liquid supplied from the liquid supplier 9 may be provided to the probe surface, and ions may be generated on part of the probe surface. In the present embodiment, the liquid can be provided to part of a probe 31 by the liquid supplier 9 according to an ink-jet method, an electrospray method, an air-jet spray method, and a falling-drop method, so that the liquid bridge 3 and the Taylor cone 15 can be formed. As illustrated in FIG. 3, voltage may be applied to the liquid from the probe used as an electrode. Alternatively, as illustrated in FIG. 1, voltage may be applied to the liquid before the liquid is provided to the probe.

Figure 4:
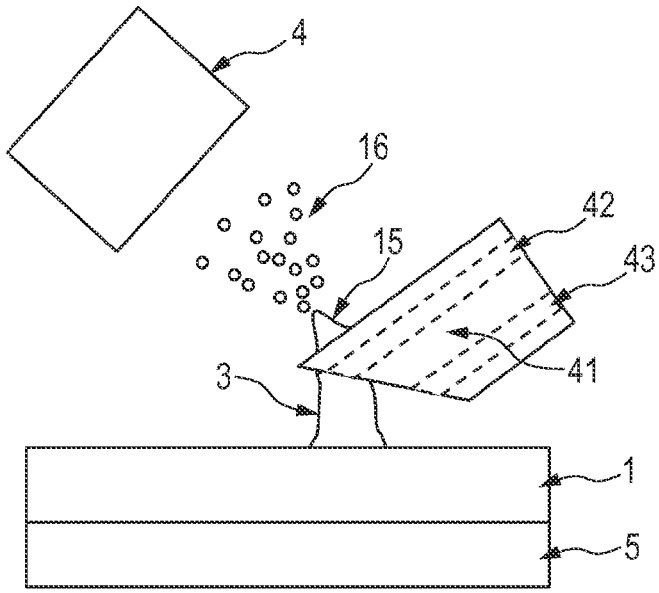
FIG. 4 is a diagram for describing a fourth embodiment of the present invention.

In a fourth embodiment of the present invention, as illustrated in FIG. 4, a probe that can supply a plurality of types of liquid may be used. In FIG. 4, a probe 41 includes a first flow path 42 configured to supply a liquid and a second flow path 43 configured to supply a liquid. The liquid bridge 3 is formed between the first flow path 42 and the substrate 1. In comparison, the amplitude of oscillations and the angle of the probe are adjusted such that the leading end of the second flow path 43 does not come into contact with the sample, whereby the liquid that comes out of the second flow path 43 can avoid forming a liquid bridge. Note that, at this time, different electrical potentials can be independently given to the first liquid flowing through the flow path 42 and the second liquid flowing through the flow path 43, through electrically conductive flow paths different from each other.

Different types of liquid may be caused to flow through the first flow path 42 configured to supply a liquid and the second flow path 43 configured to supply a liquid, or the same type of liquid may be caused to flow therethrough. For example, in the case of using different types of liquid, a solvent for dissolving components on the sample surface is introduced to the first flow path 42, and a solvent containing molecular species that react with a particular component is introduced to the second flow path 43, whereby the particular component can be selectively ionized.

Meanwhile, in the case of using the same liquid, for example, the liquid that comes into contact with the sample surface to form a liquid bridge is introduced to the first flow path 42 and the second flow path 43. At this time, because the side surface of the probe 41 is always washed by the liquid that comes out of the second flow path 43, contamination of the side surface of the leading end of the probe can be prevented, and a decrease in spatial resolution of a mass image can be prevented.

The configuration described above is given as a mere example. Hence, a spatial position relation of the flow paths may be different, and a probe including three or more types of flow paths may be used.

Figure 5:
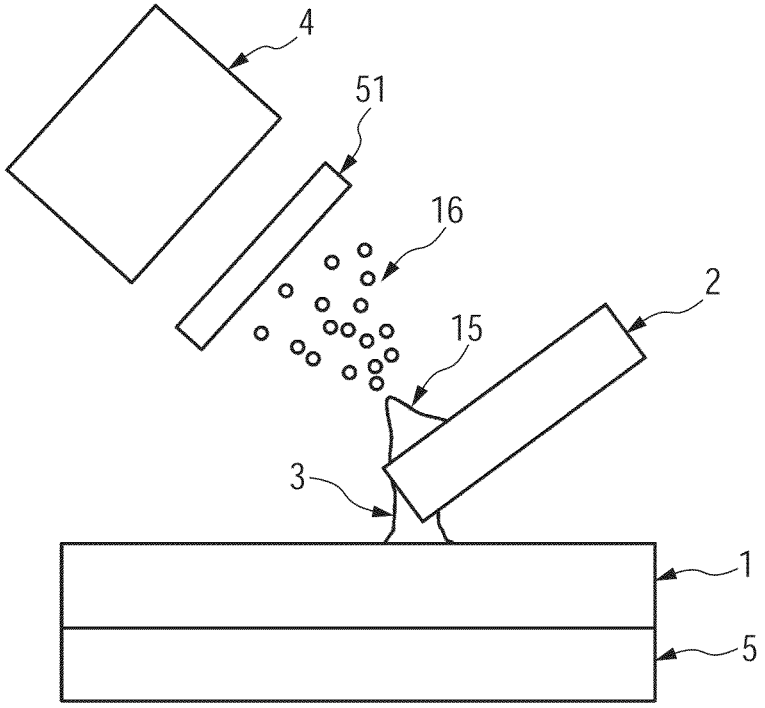
FIG. 5 is a diagram for describing a fifth embodiment of the present invention.

In the above-mentioned embodiments, the electrical potential gradient necessary to ionize components is adjusted by the electrical potential applied to the probe, the electrical potential of the ion take-in part 4, and the distance between the liquid and the ion take-in part 4, but the present invention is not limited thereto. In a fifth embodiment of the present invention, as illustrated in FIG. 5, a mechanism 51 for generating an electrical potential gradient around a liquid can be provided. In the present embodiment, the electrical potential gradient defined by the voltage applied to the liquid bridge 3, the voltage applied to the electrode 51, and the distance between the liquid bridge 3 and the electrode 51 is used to ionize components contained in the liquid. The electrode 51 can have a ring-like shape, a mesh-like shape, a dot-like shape, and a rod-like shape.

In the present embodiments, an ionization target sample is not particularly limited. If the ionization target is an organic compound made of macromolecules of lipid, sugar, and protein, these substances can be easily soft-ionized according to the methods of the present embodiments.

According to the present invention, in particular, components in a sample containing an organic substance can be changed into multiply charged ions. If multiply charged ions having a large valence can be formed from biological components having a large molecular weight, even a mass spectrometer whose measurable mass-to-charge ratio is low can detect the biological components, and hence costs concerning the measurement can be reduced.

Since each ion has an intrinsic mass-to-charge ratio, if the intensity of an external electrical potential gradient is adjusted, only a particular ion can be separated. That is, a particular component in a mixture can be extracted and purified. For example, only a protein component having an affinity for a particular site of a biological body can be separated from among a plurality of components contained in a fractured extract of a cultured cell. Then, if the separated particular component is imparted to the surface of a given substance, functions of the particular component can be added to the given substance. Further, if a component that specifically reacts with a particular disease site is imparted to the surface of a medicinal agent, an effect of improving medicinal benefits can be expected. Further, if a substance such as protein that is separated and purified according to the method of the present invention is imparted to the surface of an object such as an artificial organ that is used in a biological body, an effect of suppressing a rejection in the biological body can be expected.

An example method of separating only a particular component includes: introducing a plurality of ion species into a vacuum chamber; separating ions using an electrical potential gradient; and then collecting only particular ion components on a substrate in the vacuum chamber. With the use of this method, the substrate on which the ion components have been collected can be taken out of the vacuum chamber, and the ion components can be separated from the substrate using an appropriate solvent. Another example method thereof includes: installing an object such as an artificial organ in a vacuum chamber; and imparting separated ions directly to the object.

If a projection is provided to a portion of the probe (liquid supplier), a Taylor cone is formed along the projection, so that ions can be more stably formed.

If the frequency of oscillations is set to be equal to or more than 100 Hz and equal to or less than 1 MHz, a larger number of electric charges can be imparted for ionization to components. Then, if a larger number of electric charges are imparted to components such as protein having a large molecular weight, the components can be detected even at a low mass-to-charge ratio. Moreover, if oscillations are imparted to a liquid bridge, the volume of the liquid bridge can be changed to a desired state, so that the size of the liquid bridge can be controlled.

EXAMPLES

Hereinafter, examples of an evaluation method according to the present invention are described in detail with reference to the drawings.

Example 1

Observation Using High-Speed Camera of Ionization Apparatus

Figure 6A:
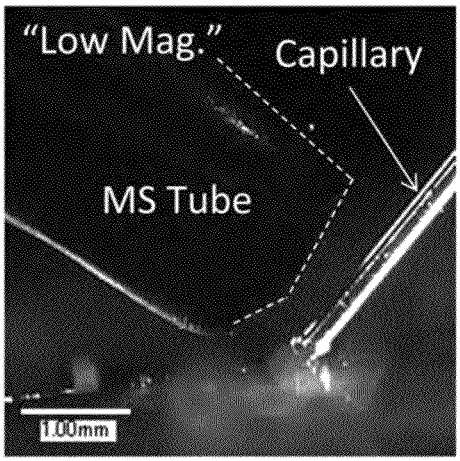
FIG. 6A is a picture illustrating an observation result of the vicinity of a liquid bridge according to Example 1 of the present invention.
Figure 6B:
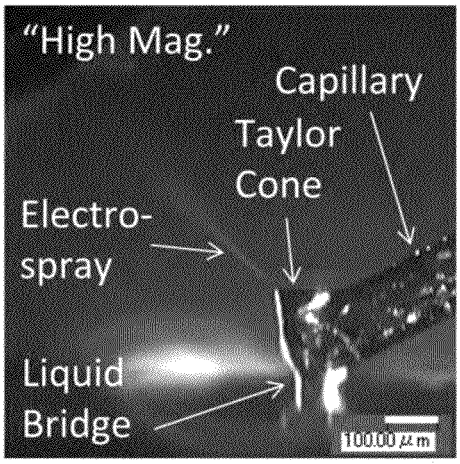
FIG. 6B is a picture illustrating an observation result of the vicinity of a liquid bridge according to Example 1 of the present invention.

Described are results of observing, using a high-speed camera, the state where a liquid bridge is formed and the state where ions are generated, using the method of the present invention. FIGS. 6A and 6B each illustrate the probe, the substrate, and the ion take-in part (MS Tube) described with reference to the diagram of FIG. 1.

FIGS. 6A and 6B illustrate the observation results of the vicinity of the liquid bridge at a low magnitude and a high magnitude, respectively. In the present example, a silica capillary having an outer diameter of 150 micrometers and an inner diameter of 50 micrometers was used as the probe corresponding to a unit configured to provide a mixture solution, the silica capillary was connected to a metal needle of a syringe, and voltage was applied to the silica capillary by a voltage applier connected to the metal needle. The syringe was fixed to a syringe pump, and a liquid could be sent out at a constant flow rate from the syringe to the leading end of the probe. A piezoelectric element (PZT) having a resonance frequency of 28 kHz was used as the oscillation provider, a polytetrafluoroethylene film was used as the substrate, and a mixture of water, methanol, and formic acid (water:methanol:

formic acid=498:498:2) was used as the mixture solution. TSQ7000 (Thermo Fisher Scientific K.K.), which was a quadrupole mass spectrometer, was used as the mass spectrometer. As illustrated in FIG. 6A, the distance between the leading end of the probe and MS Tube was about 0.5 millimeters, and the distance between MS Tube and the substrate was about 0.5 millimeters. The angle defined by the probe and the substrate in FIG. 6A was about 50 degrees, and the angle defined by the probe and the substrate in FIG. 6B was about 25 degrees. The flow velocity of the mixture solution was 0.2 microliters/minute. MS Tube was connected to TSQ7000, an electrical potential of 37.5 V was applied to the connection portion, and the temperature was set to 250° C.

In FIG. 6B, the liquid bridge formed between an area below the capillary and the substrate was clearly observed. Further, the mixture solution formed a triangular shape in an area above the leading end of the capillary, and the existence of a region bright in contrast was observed in the extension of the triangular shape. These respectively correspond to occurrence regions of a Taylor cone and micro droplets. It is considered that the mixture solution received electrostatic force and thus deformed due to the electrical potential gradient between the electrical potential provided to the mixture solution and the electrical potential of MS Tube. It is already known that the electrical potential gradient concentrates at the leading end of a Taylor cone and that charged micro droplets are emitted therefrom (electrospray method). In the present example, in the case where a voltage of 3 kV or more was applied to the probe, the formation of a Taylor cone was observed. Also in FIG. 6A, the occurrence of a Taylor cone and micro droplets was similarly confirmed.

Under this condition, solvent-derived ions were detected as result of measurement using the mass spectrometer. In comparison, in the case where a Taylor cone was not formed at the leading end of the capillary, few ions were detected. Even if some ions are detected, the ion generation was unstable. Accordingly, it is considered that the charged micro droplets were emitted from the leading end of the Taylor cone and that components inside of the droplets were ionized. As proved in this way, if a Taylor cone is formed, stable ionization is achieved.

Example 2

Study on Stable Ionization Method for Insulin Mixture Solution

Described are results of ionizing biological components according to the method of the present invention. A human insulin mixture solution (50 nM; the volume ratio of the solvent was water:methanol:formic acid=498:498:2) was provided to the substrate through the same probe as that in Example 1. The flow velocity of the mixture solution was set to 0.2 microliters/minute, and the measurement time was set to 5 minutes. In the case where a voltage of 3 kV or more was applied to the probe, human insulin ions were detected. The other experiment conditions were the same as the contents described with reference to FIG. 6B in Example 1.

Figure 7A:
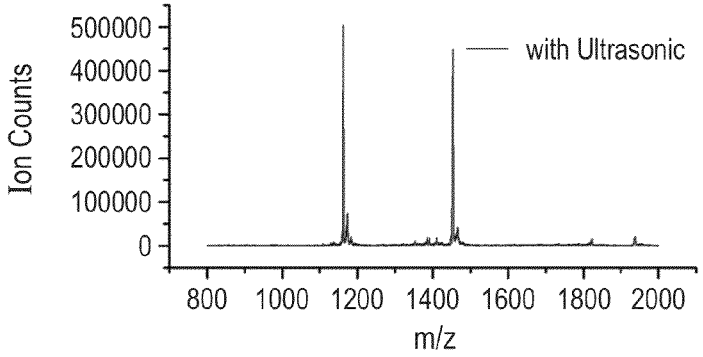
FIG. 7A is a chart illustrating a result obtained according to Example 2 of the present invention.
Figure 7B:
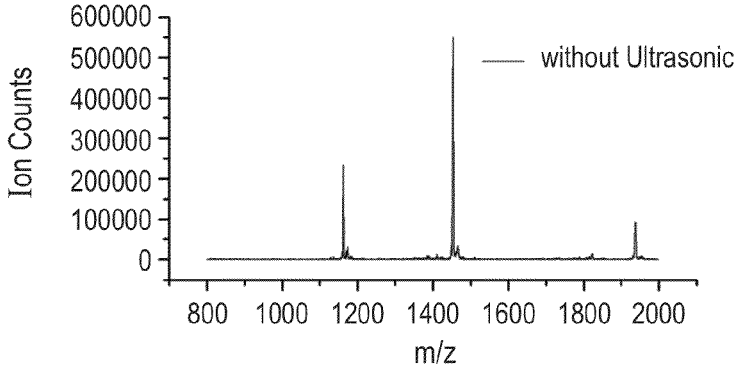
FIG. 7B is a chart illustrating a result obtained according to Example 2 of the present invention.

FIG. 7A illustrates an ion mass spectrum when oscillations are provided to the substrate, and FIG. 7B illustrates an ion mass spectrum when oscillations are not provided to the substrate. Each spectrum is data accumulated for 5 minutes. In each of FIG. 7A and FIG. 7B, the horizontal axis represents the mass-to-charge ratio (mass number/charge number), and the vertical axis represents the ion counts. In each mass spectrum, a peak was detected at 1,937, 1,453, and 1,163 m/z. These peaks respectively correspond to trivalent, tetravalent, and pentavalent ions, and it is considered that three, four, and five hydrogen ions were imparted to human insulin. In the case where oscillations were provided to the substrate, the peak intensity of the pentavalent ions was highest, followed by the peak intensities of the tetravalent ions and the trivalent ions in the stated order. In comparison, in the case where oscillations were not provided to the substrate, the peak intensity of the tetravalent ions was highest, followed by the peak intensities of the pentavalent ions and the trivalent ions in the stated order. This proves that the amount of hydrogen ions contained in human insulin ions can be increased by providing oscillations.

Figure 7C:
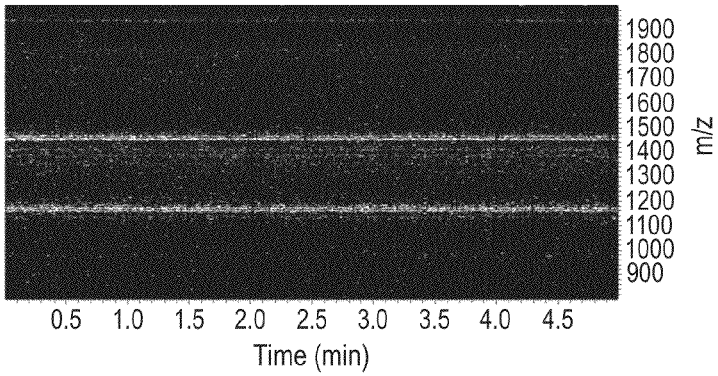
FIG. 7C is a chart illustrating a result obtained according to Example 2 of the present invention.
Figure 7D:
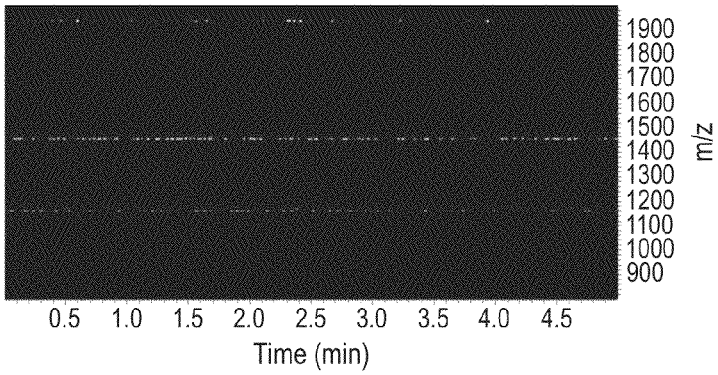
FIG. 7D is a chart illustrating a result obtained according to Example 2 of the present invention.

Next, described are results of studying a temporal change in ion intensity when human insulin ions are generated according to the method of the present invention. FIG. 7C illustrates a temporal change in ion intensity when oscillations are provided to the substrate, and FIG. 7D illustrates a temporal change in ion intensity when oscillations are stopped. In each of FIG. 7C and FIG. 7D, the horizontal axis represents time, the vertical axis represents the mass-to-charge ratio, and the amount of ions is represented by brightness contrast. That is, in each of FIG. 7C and FIG. 7D, a whiter portion means a larger amount of ions. In the case where oscillations were provided, the amount of ions was larger in portions corresponding to mass-to-charge ratios of 1,937, 1,453, and 1,163. Further, a difference in brightness contrast in the horizontal axis direction was small even at the same mass-to-charge ratio, and hence it is understood that a constant amount of ions were detected irrespective of a time passage. In comparison, in the case where oscillations were not provided, the amount of ions was small in portions corresponding to mass-to-charge ratios of 1,937, 1,453, and 1,163. Further, a difference in brightness contrast in the horizontal axis direction was large at the same mass-to-charge ratio, and hence it is understood that a temporal change in the amount of detected ions was large. This proves that human insulin ions can be stably generated by imparting oscillations. Moreover, the total amount of obtained ions was calculated. Consequently, in the case where oscillations were imparted, the amount of ions was increased by about 15% compared with the case without oscillations. This is considered to be because an effect of promoting ion generation from the leading end of the Taylor cone was produced by imparting oscillations to the liquid bridge. Conceivable mechanisms therefor include: an action that the oscillations physically cut the charged liquid bridge; and an action that friction occurs at the interface between the solution forming the liquid bridge and the substrate, to thereby increase the charging amount.

Example 3

Comparison with ESI

Next, described are results of comparing the method of the present invention with an electrospray ionization (ESI) method known as a soft ionization method for biological components. A human insulin mixture solution (50 nM; the volume ratio of the solvent was water:methanol:formic acid=498:498:2) and a bovine serum albumin (BSA) mixture solution (500 nM; the volume ratio of the solvent was water:methanol:formic acid=498:498:2) were used for the sample. The flow velocity of each mixture solution was set to 0.2 microliters/minute, and measurement was performed according to each of the method of the present invention and the ESI method. The measurement time of each method was set to 3 minutes, and the accumulated spectra were compared with each other. For the measurement according to the ESI method, an ion source adjunct to a mass spectrometer (TSQ7000, produced by Thermo Fisher Scientific K.K.) and nitrogen gas (a pressure of 0.8 MPa) were used. The experiment conditions for the method of the present invention were the same as the contents described with reference to FIG. 6B in Example 1.

Figure 8A:
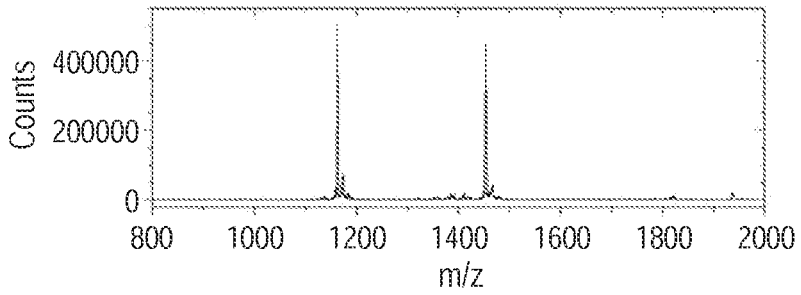
FIG. 8A is a chart illustrating a result obtained according to Example 3 of the present invention.
Figure 8B:
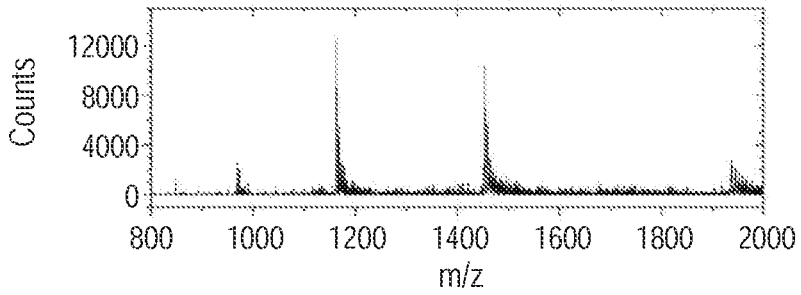
FIG. 8B is a chart illustrating a result obtained according to Example 3 of the present invention.

FIGS. 8A and 8B each illustrate the mass spectrum of the human insulin mixture solution. FIG. 8A corresponds to a result obtained according to the method of the present invention, and FIG. 8B corresponds to a result obtained according to the ESI method. In each spectrum, the peak intensity at 1,163 m/z was highest, and hence it is understood that pentavalent ions were most generated. The comparison of this peak intensity between FIG. 8A and FIG. 8B shows that the amount of ions detected according to the ionization method of the present invention is at least times larger than that according to the ESI method. This is considered to be brought about by a synergistic effect of the following two actions. For the first action, the distance from the ion generation site to the ion take-in port is short, and hence a larger number of ions are guided to the mass spectrometer. For the second action, the amount of ions separated from the liquid bridge is increased by oscillations. It is considered that, in the ESI method, a considerable amount of ions of all the generated ions are not guided to the mass spectrometer. That is, it is considered that, according to the ionization method of the present invention, the amount of ions that are not guided to the mass spectrometer can be reduced, resulting in improvement in ion detection sensitivity. Further, from the results in FIGS. 7A, 7B, 7C, and 7D, it is considered that the amount of generated ions is increased by imparting oscillations.

Figure 8C:
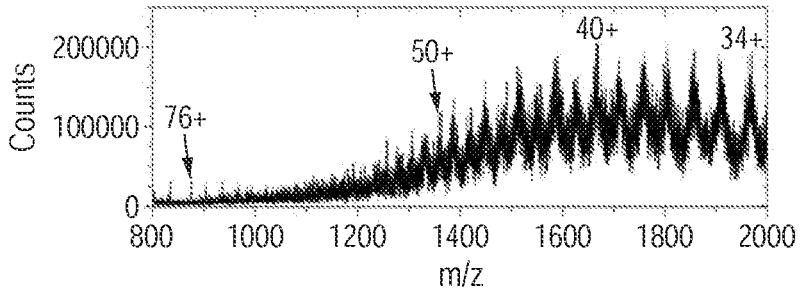
FIG. 8C is a chart illustrating a result obtained according to Example 3 of the present invention.
Figure 8D:
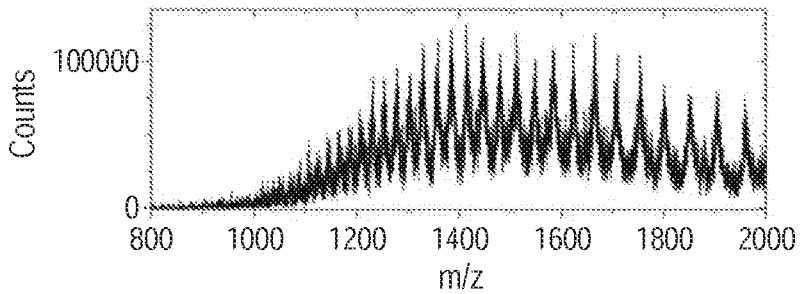
FIG. 8D is a chart illustrating a result obtained according to Example 3 of the present invention.

Next, FIGS. 8C, 8D, 8E, 8F, 8G, and 8H each illustrate the mass spectrum of the BSA mixture solution. FIG. 8C corresponds to a result obtained according to the method of the present invention, and FIG. 8D corresponds to a result obtained according to the ESI method. In each spectrum, BSA multiply charged ions were detected. The distribution of the peak intensity of the multiply charged ions was different between the two methods. Specifically, the intensity of 40-valent ions was highest in the method of the present invention, whereas the intensity of 48-valent ions was highest in the ESI method. The comparison of the ion intensity between the two methods shows that the intensity of 40-valent ions in the method of the present invention is about 1.6 times higher than the intensity of 48-valent ions in the ESI method. This is considered to be brought about by the following action, similarly to the measurement results of the human insulin. That is, the distance from the ion generation site to the ion take-in port is short, and hence a larger number of ions are guided to the mass spectrometer. Further, in the ESI method, clear peaks were detected in a region of 1,000 to 1,300 m/z. In comparison, in the method of the present invention, some peaks were detected in a region of 800 to 1,000 m/z, and one of the peaks corresponded to 76-valent ions. Consequently, it is considered that the method of the present invention can impart a larger number of hydrogen ions to BSA molecules than the ESI method.

Figure 8E:
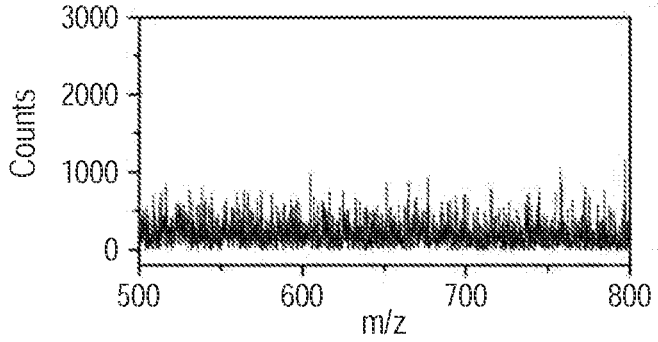
FIG. 8E is a chart illustrating a result obtained according to Example 3 of the present invention.
Figure 8F:
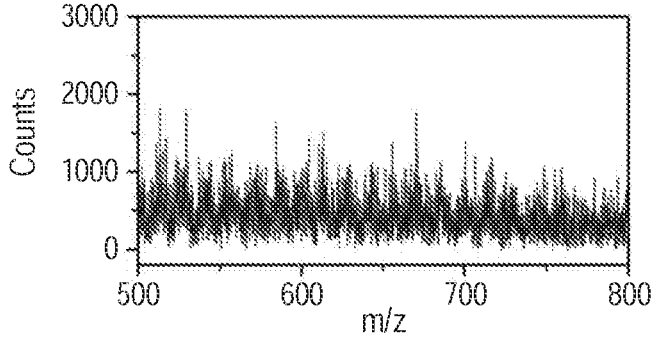
FIG. 8F is a chart illustrating a result obtained according to Example 3 of the present invention.
Figure 8G:
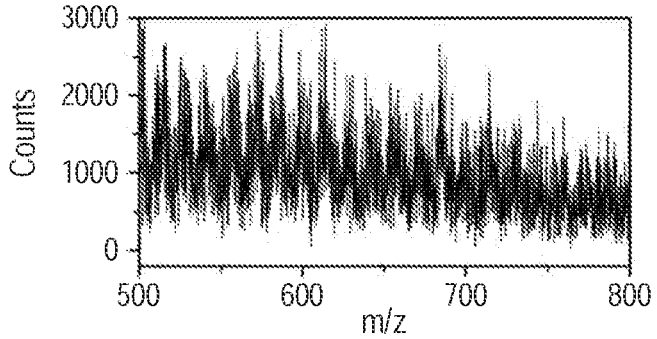
FIG. 8G is a chart illustrating a result obtained according to Example 3 of the present invention.
Figure 8H:
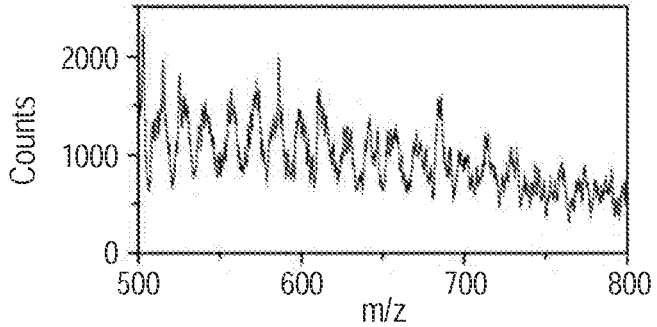
FIG. 8H is a chart illustrating a result obtained according to Example 3 of the present invention.

Next, described are results of studying an influence of the voltage applied to the probe on the ionization efficiency according to the method of the present invention. FIGS. 8E, 8F, and 8G respectively illustrate the mass spectra when the BSA mixture solution is used and voltages of 3 kV, 4 kV, and 5 kV are applied to the probe. The other experiment conditions were the same as the contents described with reference to FIG. 6B in Example 1. A plurality of peaks was detected in a region of 500 to 800 m/z, and the peak intensity became higher as the applied voltage was increased. FIG. 8H illustrates a result of performing a smoothing process (the moving average of adjacent ten points) on the spectrum data obtained when 5 kV is applied. Peaks were clearly observed compared with those in the spectrum of FIG. 8G. These peaks are considered to correspond to BSA multiply charged ions. A conceivable mechanism that could impart a larger number of electric charges than in the ESI method as described above is as follows: cavitation was caused in the liquid bridge by oscillations; and a larger number of hydrogen ions were imparted to BSA accordingly. It is known that, if cavitation is caused in a liquid, high-temperature high-pressure air bubbles are formed. It is also known that, if oscillations are given to a mixture solution containing protein dissolved therein, a higher-order structure of the protein loosens. From these known facts, it is considered that, according to the method of the present invention, a higher-order structure of BSA existing in the liquid bridge loosened and that a large number of hydrogen ions were imparted to the BSA. As described above, the method of the present invention may be capable of detecting multiply charged ions that are difficult for the conventional ESI method to detect, for example, 100-valent or higher-valent ions.

Example 4

Study on Ionization Method for Solid Insulin

Described are results of studying a method of measuring the distribution of components of a solid sample on a substrate. The sample was prepared by dropping a human insulin aqueous solution (1 μM) onto a polytetrafluoroethylene substrate and air-drying the aqueous solution. Solid white microcrystal covering the substrate was observed. The other experiment conditions were the same as the contents described with reference to FIG. 6B in Example 1. While the formation of a liquid bridge of a solvent between the leading end of a capillary and the substrate and the formation of a Taylor cone were observed using a microscope, the substrate was moved in a uniaxial direction, and a temporal change in the mass spectrum of generated ions was measured. The frequency of an oscillator fixed to the rear side of the substrate was set to about 28 kHz. An operation of generating 14,000 oscillations and an operation of stopping the oscillations for the same length of time were alternately performed. From the observation using the high-speed camera and the measurement of the mass spectrum, it was confirmed that a liquid bridge was stably formed during the stop of oscillations and that ions were stably generated during the generation of oscillations.

Figure 9A:
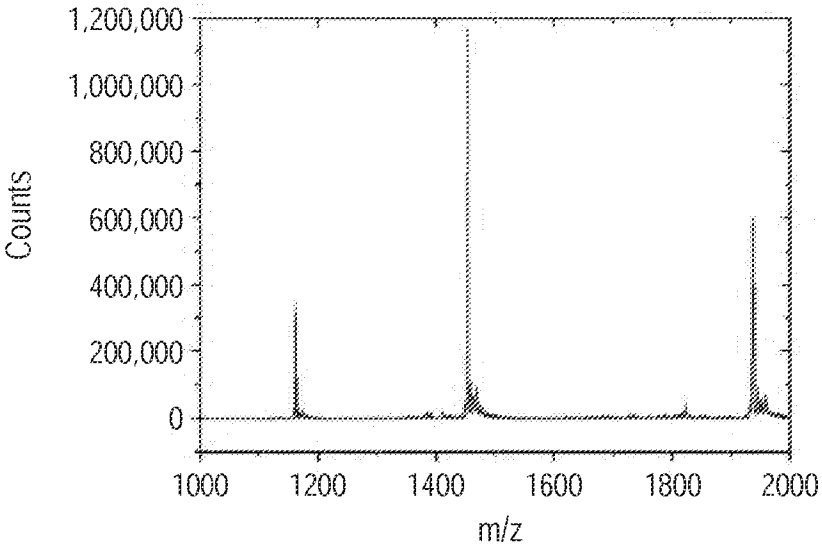
FIG. 9A is a chart illustrating a result obtained according to Example 4 of the present invention.

FIG. 9A illustrates the mass spectrum. In FIG. 9A, a peak was detected at 1,937, 1,453, and 1,163 m/z. These peaks respectively correspond to trivalent, tetravalent, and pentavalent ions, and it is considered that three, four, and five hydrogen ions were imparted to the human insulin. From this result, it is considered that the solid sample on the substrate was dissolved in the solvent introduced from the capillary, and was then ionized through the Taylor cone. The distribution of each ion intensity in the spectrum was different from the distribution of the peak intensity in each of Example 3 and Example 4. That is, the peak intensity became lower in order of the tetravalent, trivalent, and pentavalent ions. This is considered to be because, in the present example, the time that is required for the solid sample to be dissolved in the solvent and ionize is shorter, and the amount of hydrogen ions imparted to the human insulin is smaller, compared with the case of using a mixture solution in which a sample is dissolved in advance in a solvent.

Figure 9B:
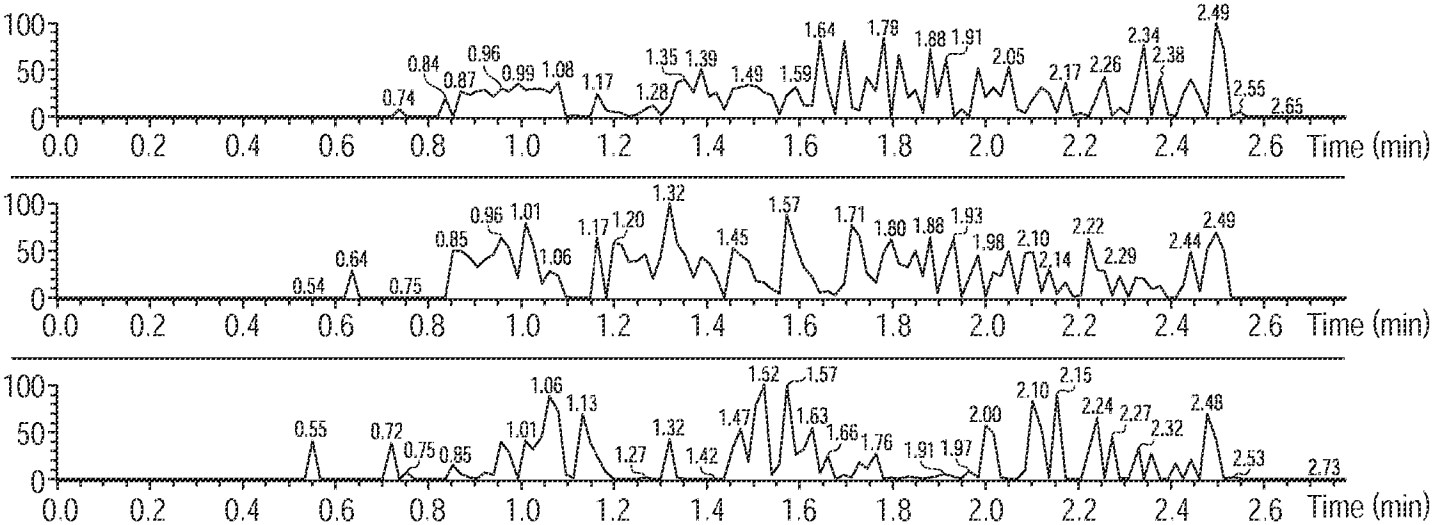
FIG. 9B is a chart illustrating a result obtained according to Example 4 of the present invention.

FIG. 9B illustrates temporal changes in the intensities of the multiply charged ions detected in the present example. The temporal changes in the intensities of the pentavalent, tetravalent, and trivalent ions are illustrated in order from the above. In spite of using the sample in which the human insulin solid microcrystal existed over the entire surface of the substrate, ions were detected only in a period from 0.5 minutes to 2.6 minutes. This period corresponds to a region in which oscillations of the oscillator are generated, and it is proved that the solid sample is stably ionized by providing oscillations to the substrate.

Example 5

Study on Ionization Method for Solid BSA

Described are results of studying a method of measuring the distribution of components of a solid sample on a substrate. The sample was prepared by dropping a BSA aqueous solution (1 μM) at four points on a polytetrafluoroethylene substrate, absorbing a surplus aqueous solution at each point after one minute, and air-drying the aqueous solution. The formation of circular thin films was observed on the substrate. Subsequently, a solvent (the volume ratio of the solvent was water:methanol:formic acid=498:498:2) was introduced to the sample surface through a capillary. The flow velocity of the solvent was set to 0.3 microliters/minute, and a voltage of 3 to 5 kV was applied to the probe. While the formation of a liquid bridge of the solvent between the leading end of the capillary and the substrate and the formation of a Taylor cone were observed using a microscope, the substrate was moved in a uniaxial direction. At this time, the liquid bridge was adjusted so as to pass by all the four extremely thin films on the substrate. The other experiment conditions were the same as the contents described with reference to FIG. 6B in Example 1.

Figure 10A:
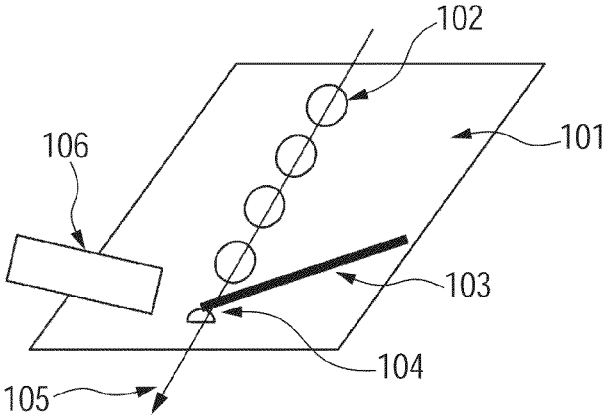
FIG. 10A is a diagram illustrating a result obtained according to Example 5 of the present invention.
Figure 10B:
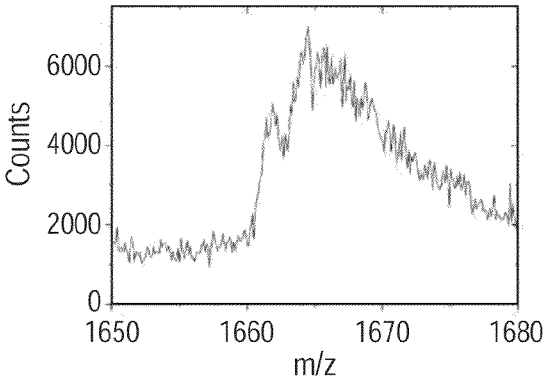
FIG. 10B is a chart illustrating a result obtained according to Example 5 of the present invention.
Figure 10C:
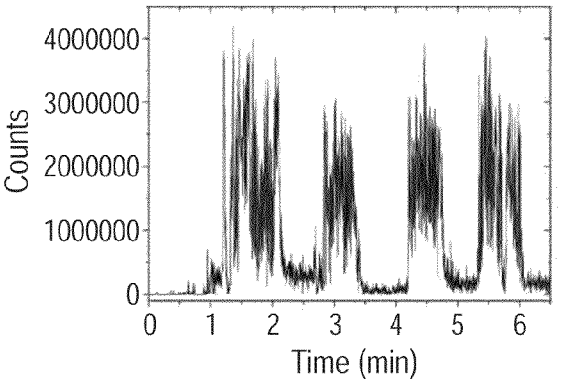
FIG. 10C is a chart illustrating a result obtained according to Example 5 of the present invention.

FIG. 10A is a diagram illustrating the sample used in the experiment and the movement direction of the substrate. FIG. 10A illustrates: a substrate 101; extremely thin films 102 made of BSA; a capillary 103; a liquid bridge 104; an arrow 105 indicating the movement direction of the substrate; and a tube 106 for introducing ions into the mass spectrometer. An operation of generating 14,000 oscillations of the substrate and an operation of stopping the oscillations for the same length of time were alternately performed. The mass spectrum of generated ions was measured together with a temporal change thereof. The measurement range of the mass spectrum was set to between 1,650 and 1,680. This corresponds to a region in which the spectrum of 40-valent ions exists. FIG. 10B illustrates the mass spectrum. The highest peak intensity was found at 1,665. FIG. 10C illustrates the temporal change of the ions obtained in the region between 1,660 and 1,680. It is confirmed that 40-valent ions were generated each time the liquid bridge passed by the four BSA thin films. This proves that the method of the present invention can visualize the distribution of the components of the solid sample. In the present example, described are the results when the frequency of oscillations is 28 kHz, but the frequency is not limited thereto. The ion efficiency is improved better if the frequency is equal to or more than 100 Hz and equal to or less than 1 MHz.

Example 6

Control of Liquid Bridge Size by Oscillation Amplitude

Figure 11A:
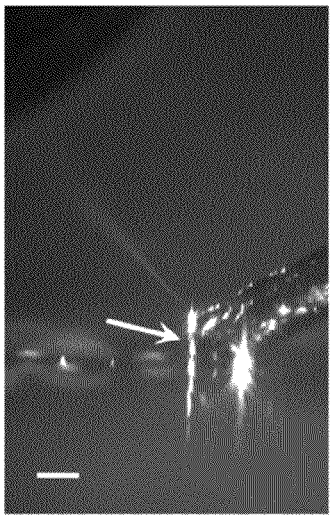
FIG. 11A is a picture illustrating an observation result of the vicinity of a liquid bridge according to Example 6 of the present invention.
Figure 11B:
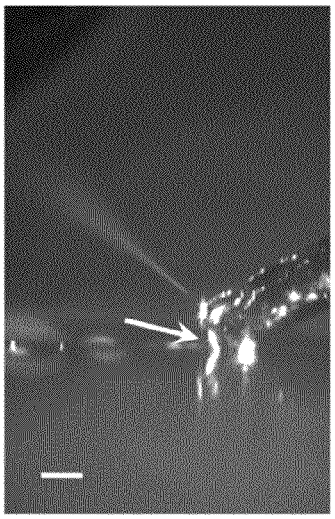
FIG. 11B is a picture illustrating an observation result of the vicinity of a liquid bridge according to Example 6 of the present invention.
Figure 11C:
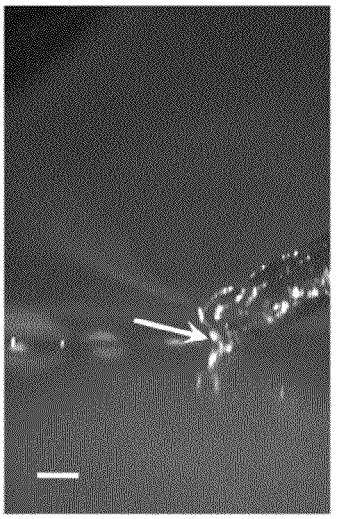
FIG. 11C is a picture illustrating an observation result of the vicinity of a liquid bridge according to Example 6 of the present invention.

Described are results of studying the correlation between the amplitude of oscillations given to a liquid bridge on a substrate and the size of the liquid bridge. A sample including a polytetrafluoroethylene substrate was prepared, and a solvent (the volume ratio of the solvent was water:methanol:formic acid=498:498:2) was introduced to the sample surface through a capillary. The flow velocity of the solvent was set to 0.3 microliters/minute, and a voltage of 5 kV was applied to the probe. The frequency of an oscillator fixed to the rear surface of the substrate was set to about 28 kHz, and a voltage input to the oscillator was set to 0 V, 20 V, and 30 V (effective values). The other experiment conditions were the same as the contents described with reference to FIG. 6B in Example 1. It was confirmed, using a laser displacement meter, that the amplitude of oscillations increased with respect to the input voltage and that an actual amplitude was about 0.7, 1.5 micrometers, respectively. FIGS. 11A, 11B, and 11C each illustrate an observation result of the vicinity of the liquid bridge using the high-speed camera. In each of FIGS. 11A, 11B, and 11C, the liquid bridge is formed between the leading end of the probe and the substrate. FIGS. 11A, 11B, and 11C respectively correspond to input voltages of 0 V, 20 V, and 30 V. The scale bar in each figure is 100 micrometers. The formation of the liquid bridge was observed in a portion indicated by an arrow in each figure. Further, spray bright in contrast was also observed was observed in an area above the capillary, and it is considered that ions were generated therefrom. The formation of a Taylor cone was observed in the vicinity of the start point of this spray. These observation results are different from the results in Example 1 illustrated in FIGS. 6A and 6B, and the size of the Taylor cone is smaller. This is considered to be because the shape of the leading end of the capillary is different between the present example and Example 1. The capillary may be cut using a capillary cutter having a diamond knife incorporated therein, or may be cut using a scriber. FIGS. 11A, 11B, and 11C each illustrate the result when the capillary is cut using the scriber, whereas FIGS. 6A and 6B each illustrate the example when the capillary is cut using the capillary cutter. In both the cases, the formation of the liquid bridge and the Taylor cone was confirmed.

The comparison of FIGS. 11A, 11B, and 11C shows that the size of the liquid bridge becomes smaller as the amplitude increases. Because the amplitude of oscillations corresponds to the energy of oscillations, this is considered to be because the amount of ionization generation is increased by imparting the energy of oscillations to the liquid bridge, and the volume of the solution forming the liquid bridge decreases accordingly. As proved in this way, if the energy of oscillations imparted to the liquid bridge is controlled, the size of the liquid bridge can be controlled, and a region to be ionized can be adjusted, in addition to an effect of promoting ionization.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-045922, filed Mar. 1, 2012, which is hereby incorporated by reference herein in its entirety.

REFERENCE SIGNS LIST

1 substrate
2 probe
3 liquid bridge
4 ion take-in part
5 oscillation provider

6 sample stage
7 current/voltage amplifier
8 signal generator
9 liquid supplier
10 voltage applier
11 electrically conductive flow path
12 sample stage controller
13 mass spectrometer
14 voltage applier

What is claimed is:

1. An ionization method for a substance contained in a liquid, comprising:

(1) supplying the liquid onto a substrate from a probe and forming a liquid bridge made of the liquid containing the substance, between the probe and the substrate;

(2) oscillating the substrate; and (3) generating an electric field between an electrically conductive portion of the probe in contact with the liquid and an ion extraction electrode.

2. The ionization method according to claim 1, wherein the (1) supplying and forming, the (2) oscillating, and the (3) generating are performed at the same time.

3. The ionization method according to claim 1, wherein the liquid forms a Taylor cone at an end of the probe at which the liquid bridge is formed.

4. The ionization method according to claim 1, wherein, in the (3) generating, part of the liquid desorps as charged droplets from the end.

5. The ionization method according to claim 4, wherein the charged droplets desorp from the Taylor cone.

6. The ionization method according to claim 4, wherein the charged droplets cause a Rayleigh fission.

7. The ionization method according to claim 1, wherein the probe includes a flow path through which the liquid passes.

8. The ionization method according to claim 7, wherein the probe includes a plurality of the flow paths.

9. The ionization method according to claim 1, wherein the liquid is supplied to the substrate through a surface of the probe.

10. The ionization method according to claim 1, wherein the substance is fixed onto the substrate, and the liquid dissolves the substance in a region in which the liquid bridge and the substrate come into contact with each other.

11. The ionization method according to claim 1, wherein the probe scans the substrate.

12. The ionization method according to claim 1, wherein the oscillation has a frequency that is equal to or more than 100 Hz and equal to or less than 1 MHz.

13. A mass spectrometry method comprising supplying, to a mass spectrometer, the substance ionized using the ionization method according to claim 1, to thereby perform mass spectrometry.

14. An extraction or purification method for a substance, comprising separating, from the liquid, the substance ionized using the ionization method according to claim 1 by means of an electrical potential gradient, to thereby extract or purify the substance.

15. An ionization apparatus for a substance, comprising:

an oscillator configured to oscillate a substrate;

a probe configured to supply a liquid onto the substrate and form a liquid bridge made of the liquid, between the probe and the substrate;

an ion extraction electrode; and a voltage applier configured to generate an electric field between an electrically conductive portion of the probe in contact with the liquid and the ion extraction electrode.

* * * * *